United States Patent [19]

Fritz et al.

[11] Patent Number: 5,005,739

[45] Date of Patent: Apr. 9, 1991

[54] RAILROAD HOPPER CAR OUTLET GATE END TUBE SEAL

[75] Inventors: William E. Fritz, Naperville; James C. Pankow, Geneva, both of Ill.

[73] Assignee: Gen-Tech, Inc., North Aurora, Ill.

[21] Appl. No.: 447,056

[22] Filed: Dec. 7, 1989

[51] Int. Cl.[5] ..... B67D 3/00

[52] U.S. Cl. ..... 222/542; 222/185

[58] Field of Search ..... 222/542, 153, 185, 545, 222/505

[56] References Cited

U.S. PATENT DOCUMENTS 2,833,318 6/1958 Obarski et al. ..... 222/545

4,114,785 9/1978 Dugge ..... 222/545

*Primary Examiner*—Michael S. Huppert

*Assistant Examiner*—Pamela Jordan

*Attorney, Agent, or Firm*—Kinzer, Plyer, Dorn, McEachran & Jambor

[57] ABSTRACT

A seal for use between the end tube and the end plate of the outlet gate of a railroad hopper car has a generally flat body with a periphery generally coextensive with the end tube. The body is formed of an elastic material and has a shaft opening in alignment with the valve shaft of the outlet gate and a discharge opening in alignment with the discharge opening of the outlet gate end plate. There is a continuous elastic seal extending outwardly from each face of the flat body, with the seals each extending about the shaft opening and the discharge opening and being adapted to be in compressive contact with the end tube and the end plate when the outlet gate is assembled.

10 Claims, 3 Drawing Sheets

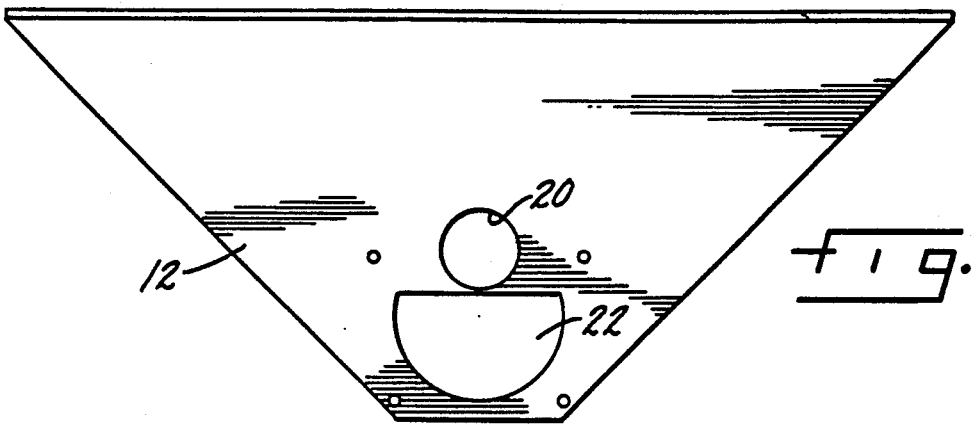
Fig. 2.
Fig. 3.
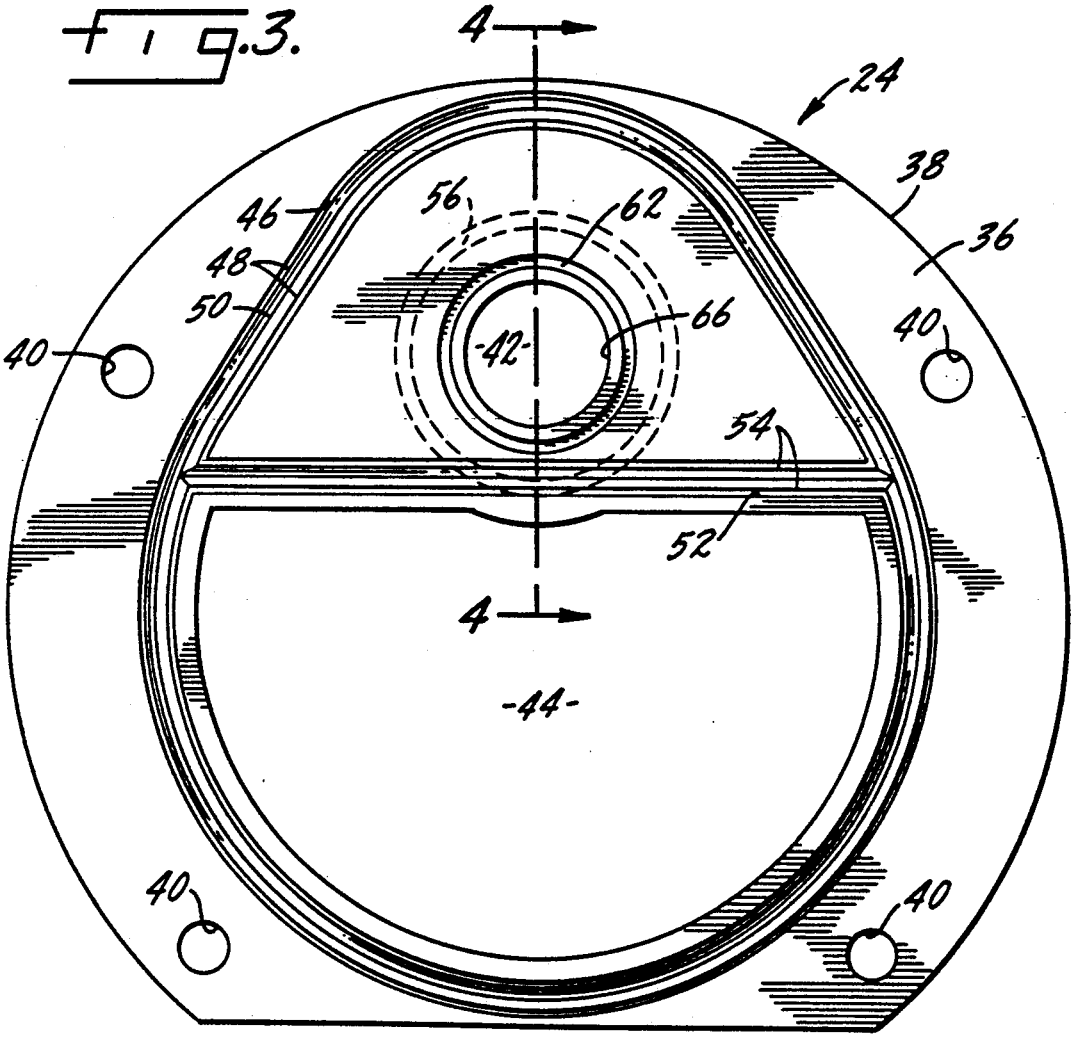

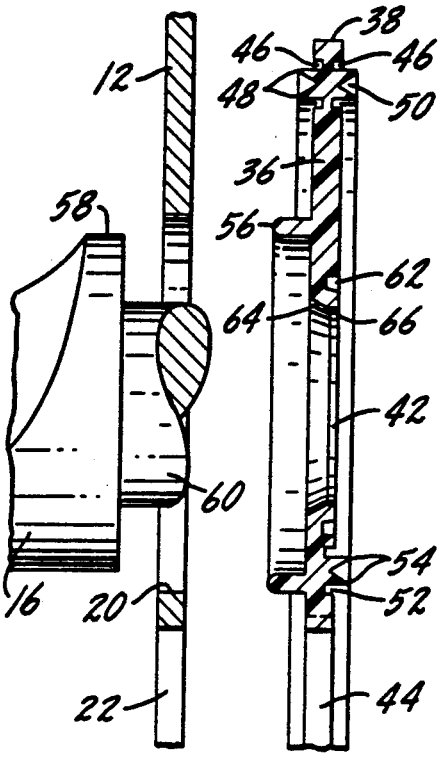
fig.4.
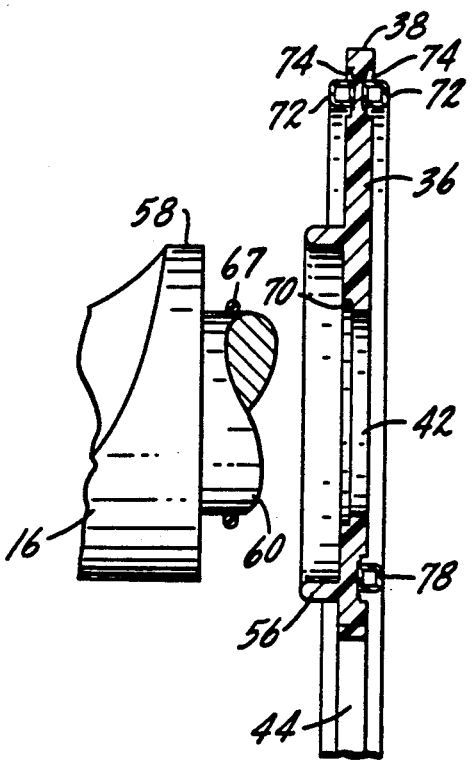
fig.6.
fig.5.
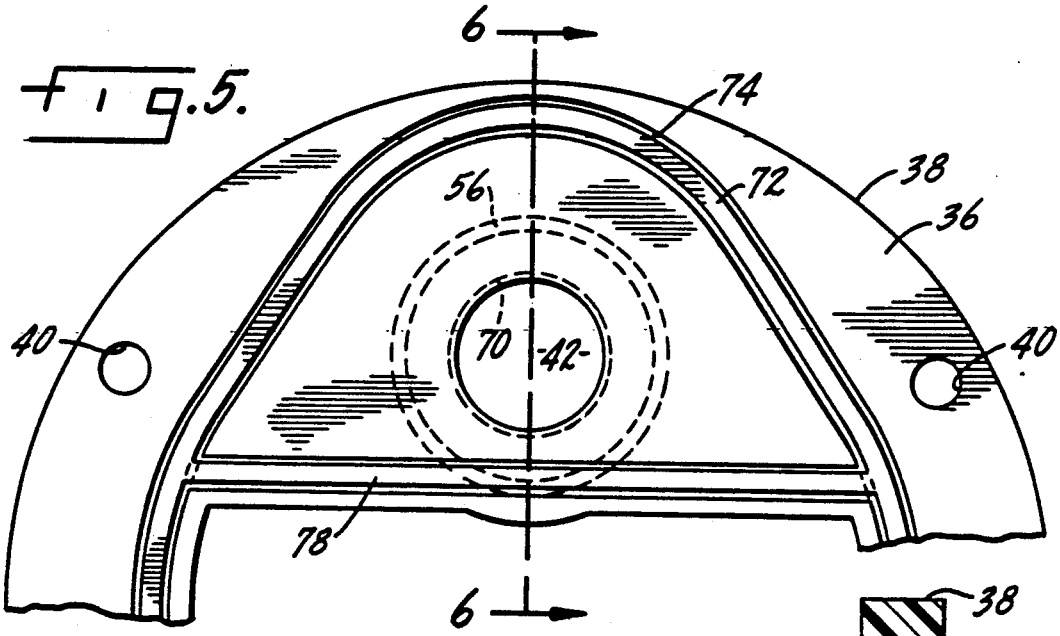
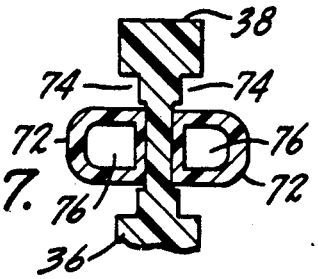
fig.7.

RAILROAD HOPPER CAR OUTLET GATE END TUBE SEAL

SUMMARY OF THE INVENTION

The present invention relates to the outlet gate of a railroad hopper car and in particular to a new and improved seal for use between the end tube and the end plate of the outlet gate.

A primary purpose of the invention is a seal for the use described which has an outwardly-extending seal element on each side thereof which seal element extends peripherally about the valve shaft and discharge openings.

Another purpose is a seal for the use described which eliminates the separate valve bearing used in previous end tube constructions.

Another purpose is a seal, as described, which positively seals to both the end tube and the end plate, without any distortion of the seal about either of its openings.

Another purpose is a seal of the type described which tightly seals against the valve shaft.

Another purpose is a seal for the use described which includes an integral bearing sleeve.

Another purpose is a simply constructed, reliably operable seal for the use described which is in sealing contact with the end plate of the outlet gate, the end tube and the valve shaft.

Other purposes will appear in the ensuing specification, drawings and claims.

BRIEF DESCRIPTION OF THE DRAWINGS

The invention is illustrated diagrammatically in the following drawings wherein:

FIG. 2 is a front view of the end plate of the outlet gate of the structure shown in FIG. 1, FIG. 3 is a plan view of the seal of the present invention, FIG. 4 is a section along plane 4—4 of FIG. 3, FIG. 5 is a partial plan view of a modified form of seal, FIG. 6 is a section along plane 6—6 of FIG. 5, and FIG. 7 is an enlarged section illustrating the elastic seal of the embodiment illustrated in FIGS. 5 and 6.

DESCRIPTION OF THE PREFERRED EMBODIMENT

Figure 1:
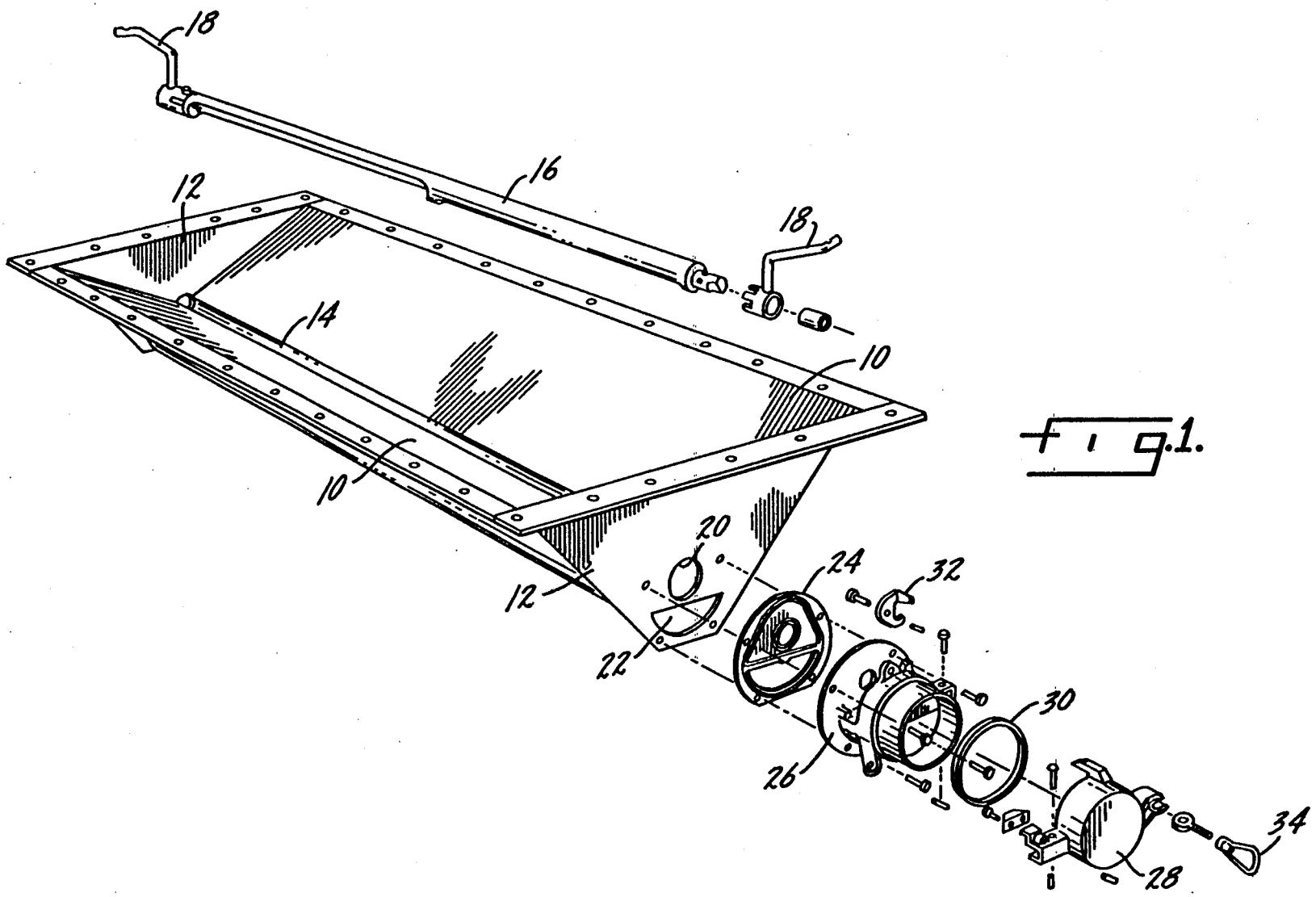
FIG. 1 is a perspective, in exploded form, illustrating the parts of the outlet gate of a railroad hopper car.

FIG. 1 illustrates the various parts of the outlet gate which forms the discharge for a railroad hopper car. The gate includes slanted slope sheets 10 and end sheets or end plates 12 at opposite ends. There is a trough 14 which spans the space between the bottom edges of the slope sheets 10. The outlet gate has an identical discharge at each end and includes a valve shaft 16, operable from either end by handles 18. Value shaft 16 extends through a shaft opening 20. There is a discharge opening 22 in each end plate. The end tube seal is indicated at 24 and is in contact with the end plate and has openings which are in alignment with shaft opening 20 and discharge opening 22. Positioned adjacent the end tube seal is the end tube 26 which has a cap 28 mounted thereto and a cap seal 30. There are various other parts to the end tube structure, including a shaft lock 32 and an eyebolt 34 which is used in locking valve shaft 16 in a predetermined position.

The present invention is specifically concerned with the construction of seal 24. In prior seal structures, which were usually made of an elastic material such as neoprene, when the seal was compressed fully between the flange of the end tube and end plate 12, the gasket was often distorted into the discharge opening where the material is flowing outwardly from the hopper car. The material flows through the discharge opening 22 with sufficient force that it can and has in fact pulled off tiny pieces of the end tube seal and this foreign material mixes with the chemical from the hopper car and contaminates it. The present invention eliminates that problem by a specific seal construction and furthermore includes as an integral part of the seal a valve bearing for the valve shaft 16, which bearing was a separate element in prior constructions.

Looking specifically at FIGS. 3 and 4, the seal 24 has a body 36 which is formed of an elastic material. The outer periphery 38 of body 36 is generally coextensive with the end flange of end tube 26. There are bolt holes 40 in body 36 which are in alignment with similar holes and in the end plate 12 for mounting the seal and end tube to the discharge gate.

Body 36 has a shaft opening 42 and a discharge opening 44, these openings being in alignment with openings 20 and 22 in end plate 12. There is an outwardly-extending elastic seal on each side of body 36 which includes a continuous groove 46 on each side of the body and surrounding both shaft opening 42 and discharge opening 44. Positioned in each groove 46 is a seal element which is formed of a pair of spaced outwardly-extending projections 48 with a groove 50 between the projections. When the seal is pressed between the end tube and the end plate, projections 48 are compressed and will be distorted within the confines of groove 46 so that there is a firm seal, peripherally about both the shaft opening and the discharge opening between the end tube and the end plate. Although the invention shows a pair of spaced and divergent projections, other seal constructions may be equally satisfactory. What is important is to provide a seal structure in which the outwardly-extending seal elements will distort within the confines of the recess when the seal is under load. The seal projections 48 are integral with the body 36 and are formed of the same elastic material.

In addition to the continuous groove 46 and the seal elements positioned therein, there is a crossover seal on the side of body 36 which faces the end tube. The crossover seal includes a groove 52 and outwardly-extending projections 54. The construction of the crossover seal is the same as the continuous seal and the crossover seal connects spaced points of the continuous seal and divides the space between the shaft opening 42 and the discharge opening 44.

As particularly shown in FIG. 4, there is an outwardly-extending bearing sleeve 56 on the side of body 36 facing end plate 12. The bearing sleeve 56 is of a size to receive the end shoulder 58 of valve shaft 16. The smaller portion 60 of the valve shaft extends through shaft opening 42, whereas, the shoulder will be positioned within bearing sleeve 56 and will abut against the face of the body 36 when the gate is fully assembled.

In order to form a positive seal between body 36 and shaft 60, there is a small circular recess 62 formed in the face of body 36 facing the end tube. Shaft opening 42 has a conical portion 64 and an axial portion 66 which is spaced radially inwardly from the conical portion and which has an inner diameter slightly less than the outer diameter of shaft 60. Thus, there is an interference fit between body 36 and shaft 60, with that portion of the body, which surrounds the shaft distorting outwardly and at least in part reducing the size of recess 62. When the end tube as assembled onto the shaft, the seal will expand because of the interference fit with the shaft so that there is a tight and positive seal on the shaft. However, the permitted expansion of the seal as it partially reduces the size of recess 62 will permit the shaft to turn relatively freely within the seal. This construction eliminates an O-ring which previously had bee- the element used to form a positive seal with the shaft. The O-ring construction is illustrated in the FIGS. 5, 6 and 7 embodiment.

In FIG. 5, like parts have been given the same numbers as in the FIGS. 3 and 4 embodiment. In this construction there is no recess comparable to recess 62 and an O-ring 66 is positioned about shaft 60 and when the shaft is positioned within bearing sleeve 56 the O-ring will fit within a small counterbore 70 formed adjacent to shaft opening 42.

The principal difference between the FIGS. 5, 6 and 7 embodiment and the structure shown in FIGS. 3 and 4 is that the continuous seal, identified at 72, is formed of a separate elastic sealing element having a durometer less than that of body 36. Continuous seal 72 is positioned within a groove 74 and has the configuration illustrated particularly in FIG. 7. The elements 72 are hollow, having an interior chamber 76 and are positioned within recess 74 such that when the seal is in position and load has been applied thereto, the elements 72 will distort within the confines of recess 74. The elastic material forming elements 72 is less rigid than that forming body 36 so that the seal can easily distort into the area of the recess in compressing between the end tube and the end plate.

The FIG. 5 embodiment also includes a crossover seal 78 separating the shaft opening and the discharge opening.

Of particular importance in the present invention is the elimination of any possibility of the end tube seal distorting inside of the perimeter of the discharge opening. When the seal is compressed between the end tube and the end plate, the seal is formed by the outwardly-extending seal elements which will distort under load. The body of the seal itself is not under sufficient load to distort into the perimeter of the discharge opening.

Also of significance is the inclusion of the bearing sleeve as an integral part of the seal and the use of an interference fit between the valve shaft and the seal body so as to eliminate the use of a separate O-ring.

Whereas the preferred form of the invention has been shown and described herein, it should be realized that there may be many modifications, substitutions and alterations thereto.

The embodiments of the invention in which an exclusive property or privilege is claimed are defined as follows:

1. A seal for use between an end tube and an end plate of an outlet gate of a railroad hopper car, said seal having a generally flat body with a periphery generally coextensive with the end tube, said body being formed of an elastic material, a shaft opening in said body in alignment with a valve shaft of the outlet gate, a discharge opening in said body in alignment with a discharge opening of the outlet gate end plate, and a continuous elastic seal element extending outwardly from each face of said flat body, said seal elements each extending about said shaft opening and discharge opening and being adapted to be in compressive contact with the end tube and the end plate.

2. The seal of claim 1 further characterized in that each face of said seal body has a continuous recess extending about said shaft opening and discharge opening, each of said continuous seal elements being positioned within a continuous recess, with each seal element, under load, distorting to generally fill the recess.

3. The seal of claim 2 further characterized in that each of said continuous elastic seal elements includes an outwardly-extending projection integral with the seal body.

4. The seal of claim 3 further characterized in that each of said continuous elastic seal elements includes a pair of divergent outwardly-extending projections, each said projection being integral with said seal body.

5. The seal of claim 1 further characterized by and including a bearing sleeve extending outwardly from the side of said seal body facing the end plate, said bearing sleeve being spaced from and extending peripherally about the shaft opening.

6. The seal of claim 5 further characterized by and including a groove extending peripherally about said shaft opening, slightly spaced therefrom, and in the side of said body opposite that of the bearing sleeve, said shaft opening being of a size slightly smaller than that of the valve shaft whereby the body expands about the valve shaft and distorts into said groove.

7. The seal of claim 1 further characterized by and including a further elastic seal element extending outwardly from that face of the flat body which faces the end tube and positioned between the shaft opening and the discharge opening.

8. The seal of claim 7 further characterized in that said further seal element between the shaft opening and the discharge opening extends between spaced locations of said continuous seal element.

9. The seal of claim 2 further characterized in that the continuous seal element is positioned within said recess and is formed of an elastic material of a durometer differing from that of the elastic material of said body.

10. The seal of claim 9 further characterized in that the elastic material of said body is more rigid than the elastic material of said continuous elastic seal.

* * * * *